US005887899A

United States Patent [19]

Dobbins

[11] Patent Number: 5,887,899

[45] Date of Patent: Mar. 30, 1999

[54] CONVERTIBLE BUSINESS CARD

[76] Inventor: Vincent A. Dobbins, 7064 Ducketts La., #202, Elkridge, Md. 21227

[21] Appl. No.: 679,717

[22] Filed: Jul. 12, 1996

[51] Int. Cl.[6] ..... B42D 15/00

[52] U.S. Cl. ..... 281/2; 281/5; 283/101; 283/106; 283/74; 283/75; 283/56; D19/1; D19/2

[58] Field of Search ..... 283/81, 101, 117, 283/106, 74, 75, 56; 281/2, 5, 51; 402/79, 80 R; 40/636, 299, 638, 594; D19/1, 2; D20/27; 428/192

[56] References Cited

U.S. PATENT DOCUMENTS

| | | | |
|---|---|---|---|
| 4,905,392 | 3/1990 | Klein | 40/68 |
| 4,930,928 | 6/1990 | Ristuccia, Sr. | 283/56 |
| 4,957,311 | 9/1990 | Geisenheimer | 283/56 |
| 5,318,825 | 6/1994 | Naber | 428/192 |
| 5,408,950 | 4/1995 | Porto | 281/42 X |
| 5,629,977 | 5/1997 | Fonseca | 379/144 |
| 5,640,447 | 6/1997 | Fonseca | 379/144 |

*Primary Examiner*—Frances Han
*Attorney, Agent, or Firm*—Peter Gibson

[57] ABSTRACT

A card has a printed face, a back, and a fold line which divides the card into a main portion and a flap which is foldable over the fold line so that the back of the flap is flush with the back of the main portion and the face of the card has the shape and appearance of a conventional business card. An adhesive layer is disposed on the back of the card so that with the flap open the adhesive may be exposed and the card removably adhered to a smooth vertical surface, juxtaposing the face of the flap and an auxiliary message printed upon the same with the face of the main portion. Removal of the card from the surface and either folding of the flap or separation of the same from the main portion converts the card back to one which has a face that has the shape and appearance of a conventional business card.

13 Claims, 2 Drawing Sheets

CONVERTIBLE BUSINESS CARD

BACKGROUND OF THE INVENTION

Field of the Invention

The present invention relates generally to printed matter, more specifically to such matter having revealable information, and also more particularly to means of attaching a printed business card to a substantially smooth, solid surface.

General Background

Wallet sized cards bearing printed information upon one face, typically including a person's name and or the name of a firm or company, physical and or telecommunication addresses, logo, et cetera, herein known as business cards, are well known. It is considered that the primary purpose of a business card is to provide a ready reference to a prospective client or other person who may wish to contact the entity identified by the card at a latter time. Business cards are typically carried in a wallet or other holder routinely carried on one's person. Frequently a business card is left for the attention of someone who is personally unavailable at a given time. In many such cases, however, there is no suitable place in particular to leave the business card which will ensure that it is seen by the person for whom it is intended.

Discussion of the Prior Art

Seven U.S. Patents are considered pertinent to the present invention:

| U.S. Pat. No. | Inventor | Date | Title of Invention |
|---|---|---|---|
| 4,643,452 | Chang | Feb 17 1987 | Business Card Attaching Strip; |
| 4,838,580 | Tuhkanen | Jun 13 1989 | Combined Visiting Card and Brochure; |
| 4,907,826 | Versage | Mar 13 1990 | Business Oriented Greeting Cards; |
| 4,930,928 | Ristuccia | June 5 1990 | Index Card for Index Card File; |
| 5,098,129 | Haber | Mar 24 1992 | Business Card Assembly with Self-Adhesive Backing; |
| 5,282,649 | Williams et al | Feb 1, 1994 | Combined Repositional Adhesive Sheets; |
| 5,522,622 | Segar | June 4 1996 | Greeting Cards and Method for Displaying Same. |

Chang discloses an elongated strip having backed adhesive on one face of an upper longitudinal portion for attachment along one face of the lower portion of a business card and having appropriately shaped apertures through the bottom edge for slidable engagement with the rails of a rolodex. Tuhkanen discloses a sheet with a perforated panel comprising a "visiting" or business card detachable from a folded package including a "brochure" and held in packet form by two opposed tabs each having adhesive upon one face. Versage discloses "a greeting card comprising a piece of card stock and a unitary message imprinted thereon", said message comprising a pun appropriate for sending between parties related "in a professional or business way". The card has a fold line dividing the card into two "pages" both bearing a portion of a "unitary message", the entirety of which is only visible with the card open. Ristuccia discloses an index card having two opposed substantially vertical slots for insertion of the opposed sides of a business card which is removably held by the same.

Haber discloses a dual business card with a medial perforation effecting a separable fold such that two cards are available, each with a backed adhesive on the reverse side so that the dual card may be affixed to a display surface such as a brochure cover with use of one exposed patch of adhesive and presenting a detachable business card with backed adhesive, perhaps behind the cover. Williams et al. disclose a sheet having adhesive on a portion of the reverse and a second, smaller, adhesive backed sheet removably attached to the obverse which may be detached and adhered to another surface. Segar discloses a greeting card having a central fold dividing the card into front and back panels. The reverse surface of the back panel has a portion covered by adhesive and a moveable cover for the same which may be disposed in a position which exposes the adhesive.

Statement of Need

While various means of displaying a business card and various uses of adhesive upon both greeting and business cards are known in the prior art, as evidenced by the discussion above, it is noted that none enable one to selectively modify a business card from a conventional shape and appearance to a modified form which reveals and disposes an auxiliary message in substantially the same plane as the face of the card and which may be removably attached to a substantially smooth surface such that the face of the card along with the auxiliary message are presented together.

In order to ensure that a business card left for someone will be seeen by that person upon their return to a particular location, it is considered desirable to be able to so convert a business card of a conventional shape and appearance into a card which presents an auxiliary message juxtaposed with the face of the card and which may be removably attached to the same to a substantially smooth solid surface. It is thus considered that a need for such a printed convertible card exists. Further, it is considered desirable to be able to return a card so converted to a conventional shape and appearance and a need is hence considered to exist for this additional capability.

SUMMARY OF THE INVENTION

Objects of the Invention

The primary object of the present invention is a business card which possesses two states: one conventional state characterized by conventional shape and appearance; and a converted state in which an auxiliary message is revealed and juxtaposed with the conventional face of the card and an adhesive surface is presented on the back of the card enabling removable attachment to a substantially smooth solid surface.

An ancillary object of the present invention is such a business card which further may be returned to a conventional state after use in the converted state.

A subsidiary object of the present invention is such a business card which may be returned to a conventional state after use in the converted state by folding a flap of the card which has an auxiliary message upon the face down flush with the back of the card thereby covering the adhesive and attaching the flap.

Another subsidiary object of the present invention is such a business card which may be separated into two components after conversion: one having the shape and appearance of a conventional business card; the other having said auxiliary message on the face and said adhesive surface on the back.

Principles Relating to the Present Invention

Card stock possessing a face which is printed and a back possessing an adhesive layer upon a portion thereof is further given a fold line, which may comprise a perforation, defining an edge between two portions of a convertible business card. One portion having a face with the shape and appearance of a conventional business card, the other portion comprising a flap that may be folded over said fold line such that the face of the entire card has the shape and appearance of a conventional business card. The face of the flap further bears an auxiliary message which is juxtaposed with the face of the conventional business card portion in an open position which further exposes a patch of adhesive upon the back of the card.

Two states are thus achieved, a conventional state with the flap folded down, and a converted state with the flap open. The conventional state possesses a face possessing the shape and appearance of a conventional business card. The converted state juxtaposes an auxiliary message with the face of the conventional business card portion and exposes an adhesive layer upon the back of the card so that the converted card may be removably attached to a substantially smooth solid surface.

A preferred embodiment of the principles relating to the present invention further enables the card in the converted state to be returned to a conventional state. The flap portion, in one preferred embodiment of said principles, is simply folded back flush with the back of the conventional portion of the card, concealing the adhesive and being held by the same. The attachment may be relatively removable or relatively permanent, a glossy surface on the back of he card facilitating the former and a thin film adhesive backing facilitating the latter. In another preferred embodiment of said principles the flap is removable from the conventional business card portion, the adhesive is restricted to the back of the flap and the fold line further preferably is comprised of a perforation which facilitates separation of the two portions.

It is generally preferred in fulfillment of the principles relating to the present invention that the fold line comprise the upper edge of the conventional business card portion because this is considered to be the most economic construction enabling the converted card to be removably attached to a substantially smooth solid surface which further possesses a substantially vertical inclination. However, the use of one or more lateral or otherwise oriented flaps with respect to the face of the conventional business card portion of the card will readily provide fulfillment of the principles relating to the present invention. Similarly, the fold line need not comprise a full edge of the conventional business card portion.

Other variations within the principles relating to the present invention, discussed upon a more detailed level, together with specifics regarding preferred methods of making and using a device in accordance with said principles may readily be appreciated with a reading of the detailed description following, especially with reference to the drawings attached hereto.

DETAILED DESCRIPTION OF THE PREFERRED EMBODIMENTS

Figure 1:
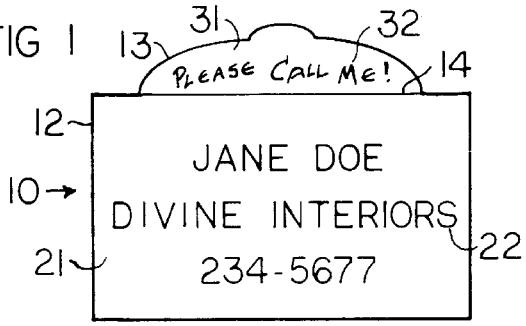
FIG. 1 is a plain elevational view taken from the front of a preferred embodiment of the principles relating to the present invention depicting a convertible business card in a converted state.
Figure 2:
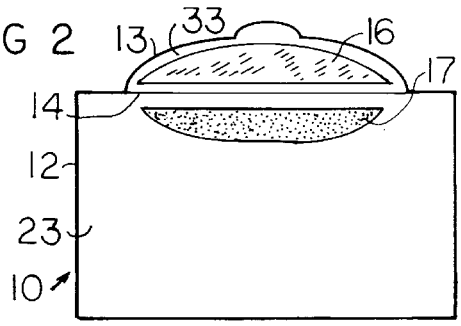
FIG. 2 is a plain elevational view taken from the rear of the convertible business card of FIG. 1 in a converted state.

FIG. 1 & 2 depict a convertible business card 10 in the open or converted state with the flap 13 bearing an auxiliary message 32 juxtaposed with the conventional printing 22, as seen in FIG. 1, and revealing an adhesive layer 17 upon the back of the card, as seen in FIG. 2. In this particular depiction the adhesive layer 17 is located upon the back 23 of the conventional portion 12 and the fold line 14 between the conventional portion 12 and the flap 13 extends along only a portion of the top edge of the conventional portion 12 as determined by the orientation given to the conventional printing 22.

The location of the adhesive layer 17, the location of the fold line 14 and thus the relative positioning of the flap 13 with relation to the conventional portion 12, among other aspects, may vary. An optional feature, a glossy surface 16 which facilitates removable attachment by the adhesive 17 without deterioration of either the adhesive 17 or the back of the card 10 contacted by the adhesive which, as depicted in FIG. 2, may be located upon the back 33 of the flap 13. It is also noted that the flap 13, clearly depicted in FIGS. 1, 2 & 4, has an outline which is curved and possesses a lobed middle which extends beyond the adhesive layer 17 in the closed position depicted in FIG. 4. This facilitates opening of the flap 13.

Figure 3:
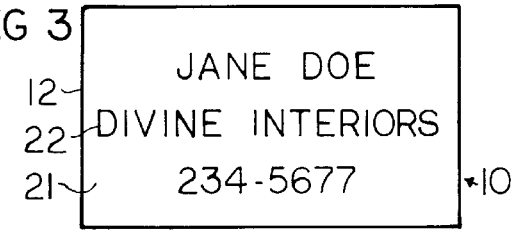
FIG. 3 is a plain elevational view taken from the front of the convertible business card of FIG. 1 in a conventional state.
Figure 4:
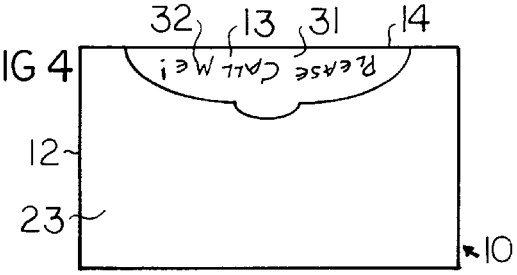
FIG. 4 is a plain elevational view taken from the rear of the convertible business card of FIG. 1 in a conventional state.

As clearly seen in FIG. 3, the face of the card 10 in the closed or conventional state with the flap 13 folded down, possesses the shape and appearance of a conventional business card. The flap 13 is further attached substantially flush with the back 23 of the conventional portion 12 as seen in FIG. 4 when in a closed or conventional state. The adhesive 17, seen in FIG. 2, is further covered by the flap 13, as seen in FIG. 4, so that the card 10 may readily be stored with other cards or otherwise used in a conventional manner without exposure of the adhesive layer 17. The specific embodiment of the principles relating to the present invention depicted in FIG. 1–4 is suited to conversion from a conventional state, as depicted in FIGS. 3 & 4, to the open or converted state, as depicted in FIG. 1 & 2, and back again into the conventional state, as a cycle, repeatedly.

Figure 5:
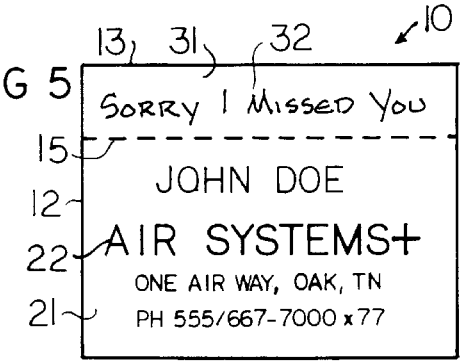
FIG. 5 is a plain elevational view taken from the front of another preferred embodiment of the principles relating to the present invention depicting a convertible business card in a converted state.
Figure 6:
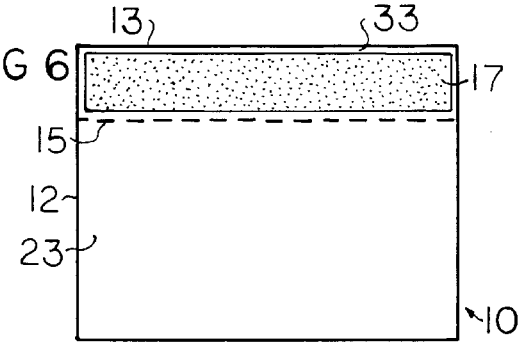
FIG. 6 is a plain elevational view taken from the rear of the convertible business card of FIG. 5 in a converted state.
Figure 7:
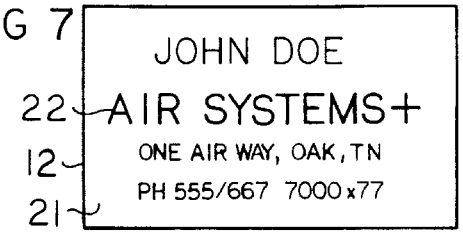
FIG. 7 is a plain elevational view taken from the front of the convertible business card of FIG. 5 in a conventional state.
Figure 8:
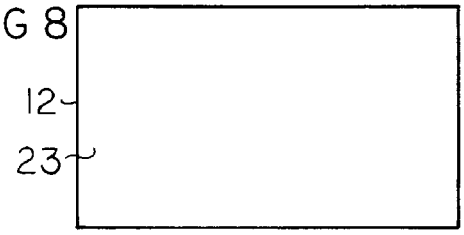
FIG. 8 is a plain elevational view taken from the rear of the convertible business card of FIG. 5 in a conventional state.

The preferred embodiment of the principles relating to the present invention depicted in FIGS. 5–8, alternatively, is suited best to a single cycle use wherein the card 10 is converted from the closed or conventional state, as depicted in FIGS. 7 & 8, into the open or converted state depicted in FIGS. 5 & 6 and, following this, the conventional portion 12 of the card 10 is readily separated from the flap 13 which typically would be discarded. A perforated fold line 15 facilitates separation and the location of the adhesive 17 upon the back 33 of the flap 13 leaves the back 23 of the conventional portion 12 free of adhesive 17. While no glossy surface 16 is depicted in this particular embodiment, such a surface upon the back 23 of the conventional portion 12 of the card 10 would help ensure that no adhesive 17 is left on the back 23 of the resulting conventional business card portion 12.

The glossy surface 16, together with other variations such as the curvilinear shape of the flap 13 depicted in FIGS. 1, 2 & 4, are considered to add additional expense to manufacture of a convertible business card 10 in accordance with the principles relating to the present invention. The embodiment of these principles depicted in FIGS. 5–8 is considered to represent the most economic construction known. The use of a perforated fold line 15 or a standard, creased, fold line 14 is considered substantially equivalent with regard to manufacturing cost. The rectangular shape of the flap 13 is considered to be less expensive than other shapes. The full length of the perforated fold line 15 along the top of the conventional business card portion 12 is also considered to be the most economic with regard to that aspect of construction.

Figure 9:
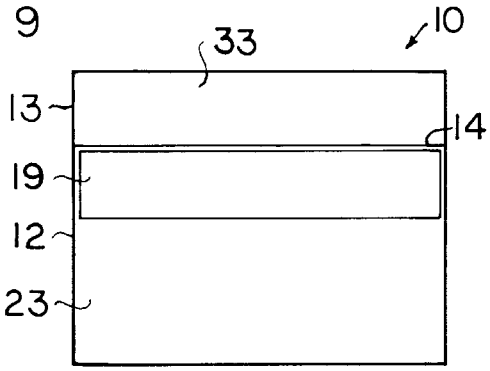
FIG. 9 is a plain elevational view taken from the rear of an another preferred embodiment of the principles relating to the present invention depicting a convertible business card in a semi-converted state, open but with backing covering the adhesive layer.
Figure 10:
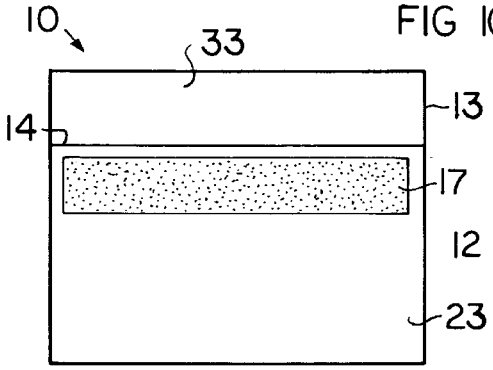
FIG. 10 is a plain elevational view taken from the rear of the convertible business card depicted in FIG. 9 in a fully converted state, open with the adhesive layer exposed.

The preferred embodiment depicted in FIGS. 9 & 10, in contrast to the previously discussed embodiments, has a thin film backing 19 over the adhesive layer 17, as seen in FIG. 9, which, when removed, exposes the adhesive 17 as shown in FIG. 10. This embodiment further has a non-perforated fold line 14 but is intended only for one use in a converted state. The flap 13 is meant to be opened, the backing 19 removed to expose the adhesive layer 17, and the converted card 10 removably attached to a surface. After removal from the surface the flap 13 may be folded back upon the adhesive 17 and thereby affixed in this position such that a business card of conventional shape and appearance is had for use in the conventional manner.

Several aspects of the elements involved here are further considered. The fold line 14 is not perforated because the flap 13 is not intended to be removed. A perforation in order to effect a fold line 14 could still function in the same manner but a simple, unperforated fold line 14 is considered more appropriate. The location of the adhesive layer 17 upon the back 23 of the conventional portion 12 of the card 10, rather than upon the back 33 of the flap 13, is just arbitrary. An adhesive layer 17 with a backing 19 located upon the back 33 of the flap 13 would function in substantially the same manner and is not inherently any more or less expensive in manufacture. Nor is either location considered any more appropriate to this mode of the present invention.

However, it is considered that the lack of a glossy surface 16 is particular to this mode, as a second use is not intended and the cost of this additional feature may therefore be avoided to economic advantage. A trade off, then, is recognized between use of either a glossy surface 16 and a backing 19. The former is advantageous to repeated cycle use in the first preferred embodiment discussed herein and is also useful in assuring that no adhesive 17 remains upon the detached conventional business card portion 12 of the second such embodiment. The backing 19 of the third such embodiment discussed may largely be substituted for the glossy surface 16 and is considered comparable in manufacturing cost.

However, the use of a thin film backing 19 is also generally considered inferior to use of a glossy surface 16 in that it fails to secure the flap 13 in the closed, conventional, state. This is important to the first preferred embodiment of the principles relating to the present invention discussed herein because it denies repeated cycle use. It is of less importance to the second such embodiment. In the third such embodiment the use of backing 19 provides what is considered an advantage in enabling a superior attachment of the flap 13 down after conversion, even though the flap 13 is unattached prior conversion. Further, neither a glossy surface 16 nor backing 19 is necessary to fulfillment of the principles relating to the present invention. Neither is present in the embodiment depicted in FIGS. 5–8. A comparatively weaker adhesive layer 17 is considered an economic advantage and is considered appropriate to the detachable mode of the second embodiment depicted in FIGS. 5–8.

Figure 11:
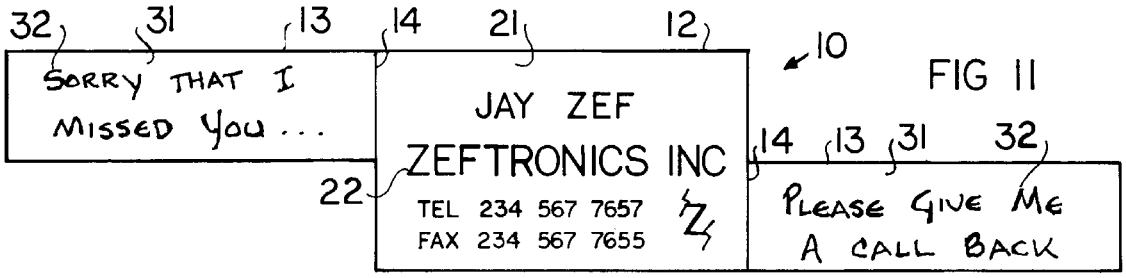
FIG. 11 is a plain elevational view taken from the front of an alternative embodiment of the principles relating to the present invention depicting a convertible business card in a converted state.
Figure 12:
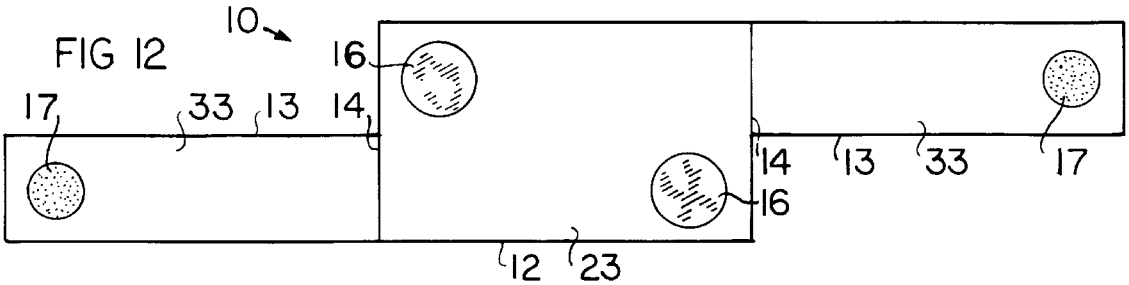
FIG. 12 is a plain elevational view taken from the rear of the convertible business card of FIG. 11 in a converted state.
Figure 13:
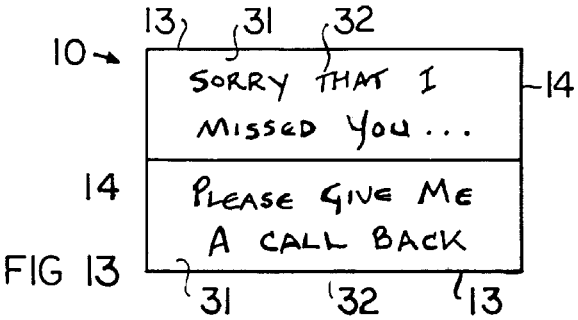
FIG. 13 is a plain elevational view taken from the rear of the convertible business card of FIG. 11 in a conventional state.

As seen in FIGS. 11–13 the disposition and the number of flaps 13 possessed by a convertible business card 10 in accordance with the principles relating to the present invention are not restricted to the top edge of the conventional portion 12 and to a single flap 13. While it is considered obvious that disposition of a single flap 13 along the top edge of the conventional portion 12 is the least expensive construction which will readily enable removable attachment of the card 10 in an open or converted state to a vertical surface, the embodiment depicted in FIGS. 11–13 will certainly enable the same capability though the construction will in all likelihood be more expensive.

As further seen in FIG. 12, it is not necessary that the adhesive 17 be restricted to a single application, nor that a stripe of adhesive, as depicted in FIGS. 2, 6 & 10, be utilized. It is noted that the configuration of the card 10 depicted in FIGS. 11–13 does allow efficient use of card stock, as opposed to the configuration depicted in FIGS. 1–4 which necessarily wastes stock with the absence of congruence between opposed sides. Upon this matter it is further observed that the shape of the conventional business card portion 12 depicted throughout FIG. 1–13 has been invariably rectangular. This is understood to follow from the efficiencies in manufacture, distribution, and ease afforded in carrying the same enabled by this standard shape.

Figure 14:
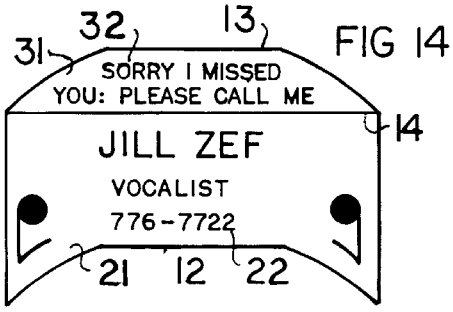
FIG. 14 is a plain elevational view taken from the front of another alternative embodiment of the principles relating to the present invention depicting a convertible business card in a converted state.

This is not to say, however, that the conventional portion 12 of a card 10 in accordance with the principles relating to the present invention must be rectangular. A card 10 possessing a conventional portion 12 which is not rectangular is depicted in FIG. 14. It is observed that the configuration depicted therein is efficient with regard to cutting of card stock, that it has two pairs of substantially parallel opposed edges, the sides, and the top and bottom, which are congruent, so that a single cut effected sequentially upon a roll of card stock will effect the configuration without waste of stock.

A very important practical aspect to the manufacture of printed cards relates to the standard convention of printing upon one face of the card only. Obviously this is considerably less expensive than printing upon more than one face. A greeting card, in contrast, necessarily possesses print upon more than one face with respect to the card stock from which it is cut. interior face of a greeting card, which is considered to provide a practical definition of the same, topologically requires that both faces of the card stock from which the greeting card is made must be printed.

With this in mind, it is noted that a convertible business card 10, in order to fulfill the principles relating to the present invention, needs to be printed on one face only of the card stock from which it is made. The auxiliary message 32 on the flap 13 is printed upon the same face of the card stock as is the conventional printing 22 upon the conventional business card portion 12. Neither the presence of a fold line 14 nor the disposition of the adhesive layer 17 upon the back of this card 10 alters the fundamental difference in the process of manufacture required for a greeting card which must have printing upon both faces of the stock and a conventional business card which only requires printing upon one face.

It is further noted that the adhesive layer 17 and any glossy surface 16 or backing 19, if employed, are all necessarily disposed upon the back of a card 10 in accordance with the principles relating to the present invention and hence upon the back of the card stock from which such a convertible business card 10 is manufactured. It is believed that this comprises an advantage in manufacture for reasons similar to the considerable cost advantage to printing one face only of card stock as discussed above. Simply put, the stock only needs to be run once through an operation with a single means of printing disposed to print upon the face of the card stock and the other, similarly singular, equipment disposed to apply adhesive 17 and, perhaps, a glossy surface 16 or backing 19 upon the back of the card stock.

The foregoing is intended to set forth what is considered to be the best manner of making and using a device in accordance with the principles relating to the present invention and is neither restrictive in any manner of the scope of the material encompassed by or the rights and privileges conferred by granting of Letters Patent for which I hereby claim:

I claim:

1. A piece of printed matter readily manufactured from card stock comprising:

a card;

said card possessing a face, which is printed, opposed to a back upon which a layer of adhesive is disposed thereon;

said card further being divided by a fold line into a conventional business card portion and a flap;

said conventional business card portion possessing a back comprising a portion of said back of said card and a face comprising a portion of said face of said card, said face of said conventional business card portion being printed and possessing the shape and appearance of a conventional business card;

said flap possessing a back comprising a portion of said back of said card and a face comprising a portion of said face of said card, said face of said flap further having an auxiliary message indicating a missed visit printed thereon, said flap further possessing the capability of being folded about said fold line whereby said back of said flap is brought in substantially flush disposition with respect to said back of said conventional business card portion;

said adhesive layer upon said back of said card enabling removable attachment of said card to a substantially smooth solid surface when said flap is not folded with respect to said conventional business card portion;

attachment of said card to said surface thereby presenting said printed face of said card facing outward from said surface with said auxiliary message indicating a missed visit juxtaposed with the printed face of said conventional business card portion and removal of said card from said substantially smooth solid surface and folding of said flap about said fold line such that said back of said flap is substantially flush with said back of said conventional business card portion thereby converting said card from an open state with an auxiliary message indicating a missed visit juxtaposed with said printed face of said conventional business card portion in a fixed location to a closed state with a face possessing the shape and appearance of a conventional business card in the hand of the person having removed the card from the surface to which it was attached and folded said flap of the same as described.

2. A card in accordance with claim 1 wherein said conventional business card portion is rectangular in shape.

3. A card in accordance with claim 1 wherein said flap is rectangular in shape.

4. A card in accordance with claim 1 wherein said fold line comprises a portion of the upper edge of said conventional business card portion.

5. A card in accordance with claim 1 wherein said fold line extends across the full upper edge of said conventional business card portion.

6. A card in accordance with claim 1 wherein said adhesive layer is located upon said back of said card such that said flap in said folded state with said back of said flap substantially flush with said back of said card is adhered shut in the folded state.

7. A card in accordance with claim 6 further possessing a thin film backing covering said layer of adhesive.

8. A card in accordance with claim 6 wherein said adhesive layer is further located upon said back of said conventional business card portion.

9. A card in accordance with claim 6 wherein said adhesive layer is further located upon said back of said flap.

10. A card in accordance with claim 9 wherein said fold line between said flap and said conventional business card portion comprises a perforation enabling separation of said flap from said conventional business card portion.

11. A card in accordance with claim 6 further possessing a glossy surface upon said back of said card which is contacted by said adhesive layer in said folded state.

12. A card in accordance with claim 11 wherein said adhesive layer is located upon said back of said conventional business card portion and said glossy surface is located upon said back of said flap.

13. A card in accordance with claim 11 wherein said adhesive layer is disposed upon said back of said flap and said glossy surface is located upon said back of said conventional business card portion.

* * * * *